United States Patent [19]

Cohen et al.

[11] Patent Number: 4,898,061

[45] Date of Patent: Feb. 6, 1990

[54] BLOCK-TYPE PERCUSSION INSTRUMENT

[75] Inventors: Wayne E. Cohen, Emerson; Donald M. Kralik, Elmwood, both of N.J.

[73] Assignee: Latin Percussion, Inc., Garfield, N.J.

[21] Appl. No.: 370,164

[22] Filed: Jun. 22, 1989

Related U.S. Application Data

[63] Continuation of Ser. No. 252,861, Sep. 30, 1988, abandoned.

[51] Int. Cl.[4] ..... G10D 13/06

[52] U.S. Cl. ..... 84/402; D17/22

[58] Field of Search ..... 84/402; D17/22

[56] References Cited

U.S. PATENT DOCUMENTS

D. 212,172 9/1968 Lewis .
D. 298,543 11/1988 Benson et al. .
471,046 3/1892 Wilskey ..... 84/402 X
3,766,683 10/1973 Vennola ..... 84/402 X
4,362,080 12/1982 DeArmas ..... 84/402 X
4,779,507 10/1988 Shimoda et al. ..... 84/402

*Primary Examiner*—Lawrence R. Franklin
*Attorney, Agent, or Firm*—Brumbaugh, Graves, Donohue & Raymond

[57] ABSTRACT

A percussion instrument comprises an oblong plastic block having a generally rectangular block portion with a front face and top and bottom surfaces, and a flange extending outwardly from the sides and rear. An elongated slot in the front face extends rearwardly to the rear flange, and laterally between the side flanges. The block has a raised ridge on the top face adjacent the front face for striking. In addition, landings are formed in the flanges which, together with a cooperating bracket assembly, act as a means for mounting the block.

12 Claims, 2 Drawing Sheets

BLOCK-TYPE PERCUSSION INSTRUMENT

This application is a continuation of application Ser. No. 252,861, filed on Sept. 30, 1988, now abandoned.

BACKGROUND OF THE INVENTION

This invention relates to a block-type percussion instrument.

There are two main classes of percussion instruments: idiophones, in which sound is produced by striking hard substances together (wood, metal, etc.), and membranophones, in which sound is produced by vibrating a stretched skin.

An example of an idiophonic percussion instrument is the traditional Chinese wooden fish, which is a form of a slit drum carved to resemble a mythical fish. The instrument is hollowed out through a ventral slit representing the creature's mouth and struck with a heavy stick. The wooden fish has subsequently been used, in various sizes, in western orchestras and referred to as a "temple block."

The assignee of the present application, Latin Percussion, Inc., presently markets wood block instruments of several designs and different woods that produce sounds characteristic of earlier Chinese wood blocks. Each is basically shaped as an oblong rectangular block characterized by an elongated slot or groove in the forward face extending substantially, but not totally, through the block. This slot acts as a sound chamber. The block is struck by another piece of wood such as a drumstick or mallet.

While wood blocks such as those sold by Latin Percussion, Inc., produce the desired sound, the instrument is relatively costly to produce. Wood is a difficult material with which to work during the production process. Machining and assembling wood are labor intensive processes which substantially increase the production costs. Moreover, as supplies of quality wood dwindle, prices continue to increase.

The instrument also has certain inherent limitations. First, wood by its nature varies in density, grain structure and other physical properties, which means that the sound and pitch will vary somewhat from piece-to-piece.

Second, splinters or cracks tend to form in the area where the block is constantly hit. Wood blocks, as a result, deteriorate significantly with use.

Third, the actual playing of wood block instruments often presents practical difficulties. It is desirable to mount the instrument on a support, but it cannot be mounted in such a way as to interfere with the sound quality (such as by clamping). Generally, the way wood blocks are mounted is to drill mounting holes into the block. The block is then positioned on a mounting piece that has a pair of forks that extend into the holes, so that the block rests loosely on the forks. This means, however, that the wood block can bounce or move around when struck. Moreover, the design limits the number of different positions into which the block may be placed. Thus mounted, the cantilevered block presents an undesirable playing surface.

Fourth, the playing surface of wood blocks is not always ideal for certain applications. Most wood block users today are drummers. Because of the aforementioned problems in mounting a wood block, it is difficult to orient a wood block so that the playing surface is at a comfortable angle for drummers. Further, the playing surfaces of certain wood blocks require a special mallet to yield the ideal sound. It is generally impractical for a drummer to switch between a drumstick and mallet while playing, which means that the drummer must settle for using a drumstick for striking such wood blocks, even though this does not produce the best sound.

Wood blocks were developed to take advantage of the unique sound properties of wood. Thus, despite the problems inherent with wood, it has long been recognized that other materials will not produce the same sound, and the only way to create an instrument with the sound of a wood block was to build it from wood.

SUMMARY OF THE INVENTION

The present invention is a block-type percussion instrument which overcomes the limitations and problems discussed above, which has a structure that can be readily and very securely mounted for use, and which is inexpensive to produce. More particularly, the inventor of the present invention has discovered that, by forming a block having a particular structure and composition, a block-type instrument can be made of plastic which will reproduce the sound of a wood block instrument without using wood.

A percussion instrument according to the invention is in the form of an oblong, plastic block having a generally rectangular block portion with front, top, and bottom faces and an elongated slot in the front face extending substantially the width and depth of the block portion. A flange extends outwardly on either side and to the rear of said block portion and includes portions that may be used for mounting the instrument on a support. Also, a raised ridge extends along the top face adjacent to the front face, which acts as a striking surface. The raised striking surface also reinforces the top vibrating surface without inhibiting the vibration characteristics.

Preferably, the flange is formed by a plurality of outwardly tapering flange sections, including a pair of laterally oriented side flange sections, a rearwardly oriented rear flange section, and a pair of connecting flange sections between the rear flange section and the side flange sections, and oriented at approximately 45°. The flange sections are frusto-conical in cross-section, terminating in a vertical, outside face, and a landing is formed in each of the side flange sections and the rear flange section. Each landing is defined by parallel top and bottom surfaces that extend inwardly from the outside faces, and includes a hole therethrough. A mounting bracket has a flat, plate portion that mates with the underside of the landings, and includes a hole that aligns with the holes in the landings for bolt mounting.

Preferably, the ridge, in cross-section, has a curved, rearwardly extending teardrop shape for effectively transmitting a striking force to the body of the instrument.

An instrument according to the invention is preferably made by molding. By controlling the density and composition of the material, the sound characteristics can be controlled as desired. Once the desired properties are selected, individual production pieces can thereafter be produced with the identical sound.

An instrument according to the invention is inexpensive to manufacture, in that it can be made by molding using readily available materials, and is inherently durable in use. Moreover, the instrument can be securely mounted in a wide variety of positions without adversely affecting the sound quality, and the striking ridge permits the optimum sound to be achieved with a drumstick, mallet, or any other hard striker.

For a better understanding of the invention, reference is made to the following detailed description of a preferred embodiment, taken in conjunction with the drawings.

DETAILED DESCRIPTION OF A PREFERRED EMBODIMENT

Figure 1:
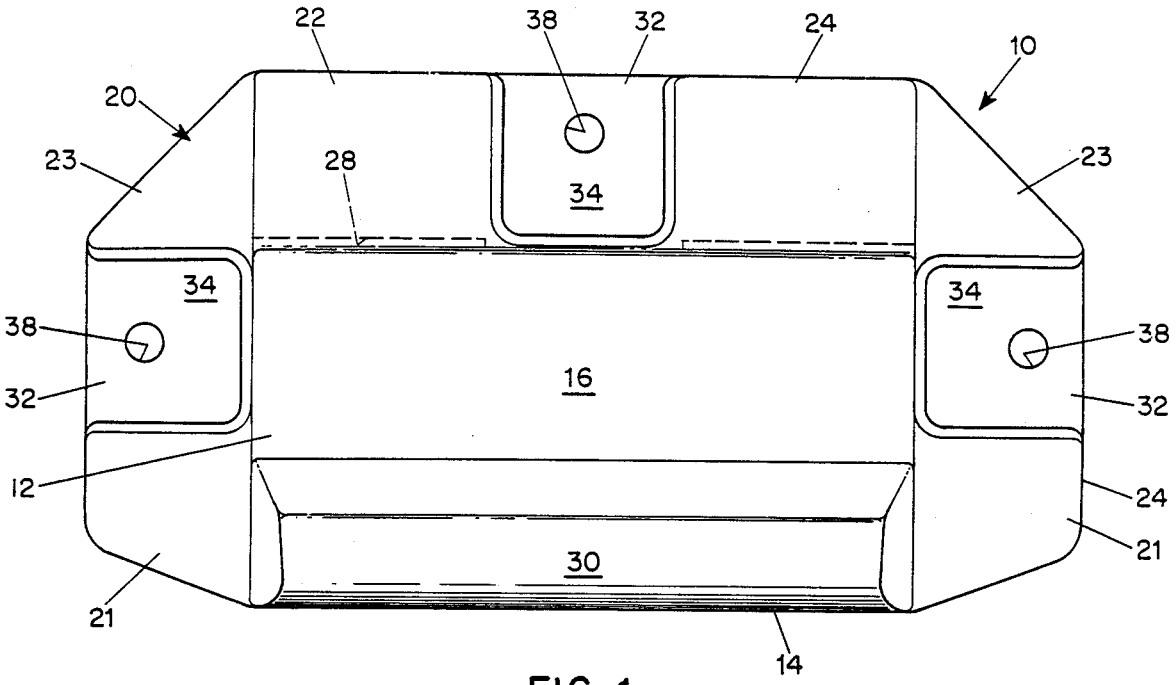
FIG. 1 is a top view of a block-type percussion instrument according to the invention.
Figure 2:
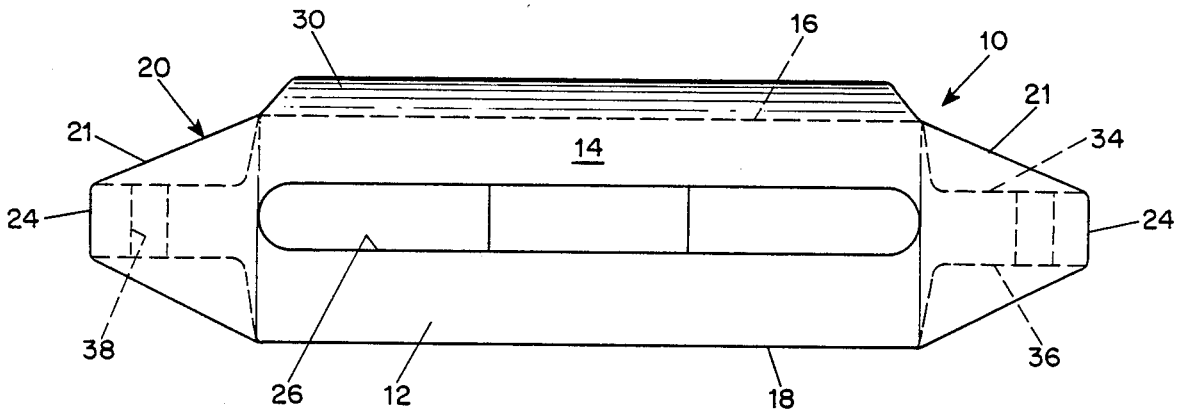
FIG. 2 is a front view of the instrument.
Figure 3:
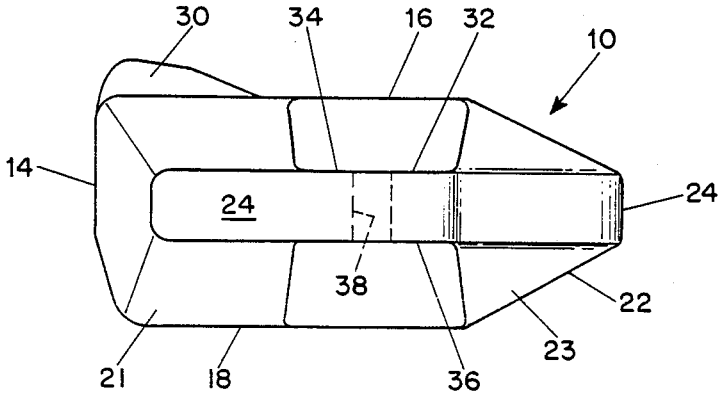
FIG. 3 is a side view of the instrument.

A percussion instrument according to the invention is made of a generally oblong block 10 of plastic material which includes a generally rectangular block portion 12 having a generally planar front face 14; generally planar top 16 and bottom 18 surfaces; and a tapered flange 20 that extends from the sides and the rear of the rectangular block portion 12. Preferably, the flange is frustoconical in cross-section, as can be seen in FIGS. 2–3, and terminates in a vertical face 24 of about one-third the height of the rectangular portion 12. The flange includes a pair of tapered side portions 21 that extend laterally, a rearwardly extending rear portion 22, and a pair of connecting portions 23, between the sides and rear, that extend at about 45°.

The rectangular block portion 12 has a slot 26 formed in its front face 14 that extends rearwardly through the block portion, terminating at approximately the rear flange 22, a shown by broken line 28. The slot 26 extends laterally across the entire block portion 12, its opposite sides terminating at the side flanges 21, thus creating a sound chamber in the block. The slot preferably has a height of approximately one quarter the thickness of the block portion 12.

By varying the slot dimension (height), it is possible to modify the sound. Thus, it is possible to change the sound merely by changing the mold core, rather than having to fabricate an entirely new mold, saving substantially on re-tooling costs. The length, width and depth of the slot are also important to defining the selected sound, and may also, if desired, be varied.

As also shown in the drawings, the block portion 12 is formed with a ridge 30 extending across the forward portion of the top surface 16. The ridge has a curved surface that extends up from the front face, and then descends more gradually toward the rear, in a rearwardly facing teardrop shape. The ridge provides a striking surface for a drumstick or other striker. Because the striking ridge is curved, it allows the drumstick to hit at a single contact point no matter what angle the block is struck.

Figure 4:
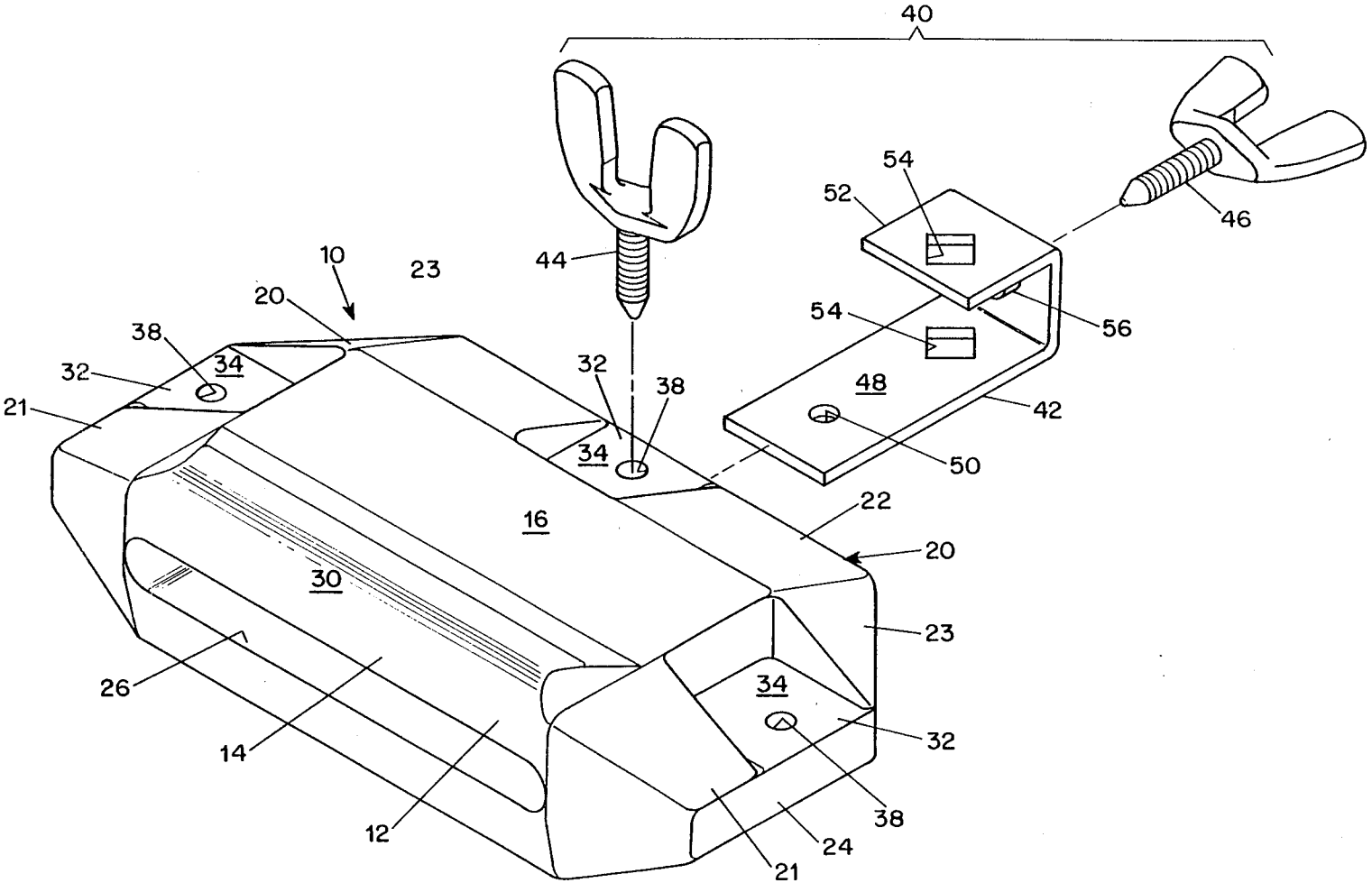
FIG. 4 is a perspective view of the instrument, together with a mounting bracket assembly.

Each of the tapered flanges 21 and 22 includes a flat cutout area or landing 32 extending inwardly from the side surfaces 24 and defined by a pair of horizontal upper 34 and lower 36 faces. A hole 38 extends through each landing 32 perpendicular to the faces 34, 36. As shown in FIG. 4, a bracket assembly 40, which includes a bracket member 42, winged bolt 44, and a second winged bolt 46, selectively engages any of the three landings 32. The bracket assembly 40 may be used for mounting the instrument as described below.

The exemplary bracket 42 has a first a flat plate portion 48, with a threaded hole 50. Where the bracket is not thick enough for threading, a nut (not shown) may be welded to the bottom surface of the plate portion 48 so as to be aligned with the hole 50. Flat plate portion 48 is sized to fit the landings 32, so that the hole 50 is aligned with hole 38, and so that the bracket can be held by a single screw without rotating relative to the block. In this manner, winged bolt 44 can be inserted through hole 38 and hole 50, and tightened down to secure the bracket to one of the flanges 20 or 22. The plate portion 48 can be mounted against the lower 36 face of the landing (with the bolt extending through the landing hole from the other side) as shown; if desired, however, the bracket may be turned upside down and mounted against the upper face 34, with the bolt extending from below.

The free end 52 of the bracket 42 may be formed so as to be attached to any desired base, rim, or other mounting surface. The embodiment shown illustrates a structure for attaching the bracket 42 to an upright post (not shown), which is a common mounting device. As shown, the free end 52 is bent into a "C" shape, and a pair of aligned square cutouts 54 are formed in upper and lower surfaces. Additionally, a threaded hole 56 (or nut) is provided in the back, upright surface for receiving bolt 46. In this manner, the bracket can be mounted by inserting a post through the cutouts 54 and clamping the bracket at the desired height using bolt 46. This structure is merely exemplary, and clamps or other attaching structure may be employed.

The block 10 (i.e., block portion 12, flange 20, and ridge 30) is preferably molded as a one piece solid block (defining slot 26 and holes 38). The plastic is preferably a polyolefin material, e.g. a high density polyethylene (polymerization of ethylene) having a density in the range of 0.941 to 0.965 gm/cc. The molding times, temperature, plastic material and additives are controlled so that each production piece will sound the same.

In an illustrative example, a block 10 has an overall width of 167 mm, a thickness (exclusive of the ridge 30) of 39 mm, and a front ridge 30 with a height of 6 mm. The block portion 12 and slot 26 each have a width of 111 mm, and a depth of 59 mm, the height of the slot being 11 mm. The flanges 21 and 23 extend outwardly a distance of 28 mm, and taper from an initial thickness of 39 mm to an outside thickness of 13 mm. Finally, the cutout areas 32 have a width of 25 mm and extend upwardly a depth of 26 mm. Preferably, the upper portion of the block is thinner than the lower part. In the figures, there is a 2:1 ratio between the thickness of the block 10 below the slot compared to the thickness of the block above the slot (i.e. exclusive of the ridge). This is important to creating the preferred desired sound.

An instrument having a construction according to the invention effectively duplicates the sound of a wood block instrument, but because of its unique structure permits the instrument to instead be made of plastic. Because of this, the instrument is more durable than wood blocks, in that the material will not crack, splinter or otherwise deteriorate. At the same time, unlike known wood blocks, the instrument can be solidly mounted, in a variety of positions, without adversely affecting the sound quality. Because it can be molded, the instrument is significantly less costly and time consuming to produce than known wood blocks. Moreover, the raised front ridge provides an improved striking surface for transmitting force to the block body, and optimum sound can be achieved with a drum stick, mallet, or any other hard striker. The placement of the mounting holes is outside the sound producing area. This allows for rigid clamping without adversely affecting the sound by constructing vibration.

The foregoing represents a preferred embodiment of the invention. Variations and modifications of the foregoing example will be apparent to persons skilled in the art, without departing from the principles of the invention. For example, the shape of the projecting flanges, and the configuration of the landings, may be varied to some degree while retaining the sound properties of the instrument. Moreover, the dimensions and compositional characteristics can be varied either to produce different size instruments with the same sound and pitch, or to deliberately alter the same in a desired manner. All such variations and modifications are intended to be within the scope of the invention, as recited in the following claims.

I claim:

1. A percussion instrument in the form of an oblong, plastic block comprising:

a generally rectangular block portion having front, top, and bottom faces and an elongated slot in the front face extending substantially the width and depth of the block portion;

a flange extending outwardly on either side and to the rear of said block portion, said flange including at least one mounting means; and a raised striking ridge extending along the top face adjacent the front face.

2. An instrument as defined in claim 1, wherein said flange is formed of a plurality of outwardly tapered flange sections including a pair of laterally oriented side flange sections, a rearwardly oriented rear flange section, and a pair of connecting flange sections between the rear and side flange sections and oriented at approximately a 45° angle relative thereto.

3. An instrument as defined in claim 2, wherein the mounting means comprises a landing formed in each of the side flange sections and the rear flange section, each landing being defined by parallel top and bottom surfaces, and wherein each landing includes a hole therethrough.

4. An instrument as defined in claim 3, wherein each of the flange sections is frusto-conical in cross-section to define a vertical, outside face, and wherein said landings extend inwardly from said outside faces.

5. An instrument as defined in claim 4, wherein said ridge, in cross-section, has substantially a rearwardly extending teardrop shape.

6. An instrument as defined in claim 3, wherein the mounting means further comprises a mounting bracket means including a flat, plate portion shaped to be selectively received in said landings and positioned against one of the landing surfaces, said plate portion further having bolt-receiving means, aligned with the landing holes, and bolt means having a threaded portion insertable through the hole of the landing into the bolt-receiving means of the plate portion, and further having a head for bearing against the other surface of the landing for securing said bracket means to said landing.

7. A percussion instrument in the form of an oblong, plastic block, comprising:

a generally rectangular block portion having front, top and bottom faces and an elongated slot in the front face extending substantially the width and depth of the block portion;

a flange extending outwardly from at least one of the two sides and the rear of said block portion, said flange including at least one mounting means; and a raised striking ridge extending along said top face adjacent said front face.

8. An instrument as specified in claim 7 wherein said flange comprises at least one outwardly tapered flange section and wherein said at least one mounting means comprises a landing formed in said flange section, said landing being defined by parallel top and bottom surfaces.

9. A percussion instrument in the form of an oblong, plastic block, comprising:

a generally rectangular block portion having front, top and bottom faces and an elongated slot in the front face extending substantially the width and depth of the block portion, said slot being spaced closer to one of said top and bottom faces than the other forming unequal wall thicknesses between said slot and said faces;

and a flange integral with said block portion extending outwardly from at least one of the two sides and the rear of said block portion, said flange including at least one mounting means, said flange comprising at least one outwardly tapered flange section and wherein said at least one mounting means comprises a landing formed in said flange section, said landing being defined by parallel top and bottom surfaces.

10. An instrument as specified in claim 9 wherein said flange extends outwardly from both of said sides and said rear of said block portion.

11. An instrument as specified in claim 9 wherein said unequal wall thicknesses are in the ratio of approximately 2:1.

12. An instrument as specified in claim 9 wherein said slot is spaced closer to said top face and further including a raised striking ridge extending along said top face adjacent said front face.

* * * * *